US009968895B1

(12) United States Patent
Dartez

(10) Patent No.: US 9,968,895 B1
(45) Date of Patent: May 15, 2018

(54) SUBMERSIBLE AERATOR

(71) Applicant: James Dartez, New Orleans, LA (US)

(72) Inventor: James Dartez, New Orleans, LA (US)

( * ) Notice: Subject to any disclaimer, the term of this patent is extended or adjusted under 35 U.S.C. 154(b) by 173 days.

(21) Appl. No.: 14/861,568

(22) Filed: Sep. 22, 2015

(51) Int. Cl.
*B01F 5/06* (2006.01)
*B01F 3/08* (2006.01)
*B01F 15/02* (2006.01)

(52) U.S. Cl.
CPC ..... *B01F 5/0606* (2013.01); *B01F 3/0807* (2013.01); *B01F 15/0262* (2013.01); *B01F 2215/0052* (2013.01)

(58) Field of Classification Search
CPC ..... B01F 5/0606
USPC ..... 366/176.1, 336–340; 261/76–77
See application file for complete search history.

(56) References Cited

U.S. PATENT DOCUMENTS 1,491,049 A * 4/1924 Lichtenthaeler ..... B01F 3/0861 261/114.1
2,737,377 A * 3/1956 Huggins ..... B01D 3/18 202/158
2,853,281 A * 9/1958 Hibshman ..... B01D 3/20 202/158
3,045,984 A * 7/1962 Cochran ..... B01F 5/0682 138/38
3,729,179 A * 4/1973 Keller ..... B01D 3/20 261/114.1
3,855,368 A * 12/1974 Prochazka ..... B01D 3/22 261/81
4,101,610 A * 7/1978 Kirkpatrick ..... B01D 3/22 202/158
4,133,714 A * 1/1979 Vorobiev ..... B01J 19/185 162/237
4,412,582 A * 11/1983 Mecozzi ..... B01F 5/0606 165/159
4,504,426 A * 3/1985 Chuang ..... B01D 3/22 202/158
4,954,294 A * 9/1990 Bannon ..... B01D 53/18 261/114.1
5,213,719 A * 5/1993 Chuang ..... B01D 3/20 261/114.1
5,888,460 A * 3/1999 Zardi ..... B01D 3/22 422/606
5,967,658 A * 10/1999 Mohajer ..... B01F 5/0616 138/42
6,029,956 A * 2/2000 McGrath ..... B01D 53/18 261/114.1
6,575,438 B2 * 6/2003 Nutter ..... B01D 3/20 261/114.1

(Continued)

OTHER PUBLICATIONS

Gardner, The use of Stainless Steel in Structures, Wiley and Sons, Progress in Structural Engineering and Materials, 2005; 7:45-55.*

*Primary Examiner* — Abbas Rashid
(74) *Attorney, Agent, or Firm* — Roy Kiesel Ford Doody & Thurmon APLC

(57) ABSTRACT

A submersible aerator apparatus is disclosed. The apparatus uses injected air to create both aeration and mixing of a liquid. The apparatus is submersible and may be lowered into a container holding a liquid with suspended and coagulated solids. Air supplied to the apparatus is injected into the liquid which results in an upward flow of air bubbles and entrained liquid. This action mixes and aerates the liquid. A method of using a submersible air-injection aerator is also disclosed.

13 Claims, 2 Drawing Sheets

(56) References Cited

U.S. PATENT DOCUMENTS 7,270,316 B2 * 9/2007 Burch ..... B01D 3/20
202/158
9,010,995 B2 * 4/2015 Soukup ..... B01F 5/0688
366/336

* cited by examiner

SUBMERSIBLE AERATOR

BACKGROUND OF THE INVENTION

The treatment and handling of waste water and sewage pose numerous challenges. For example, waste water often contains various contaminants. Some of these contaminants tend to coagulate and can form large masses that may make it difficult to move the materials. These materials are typically moved by flow, which can be gravity-induced and induced by pumps.

Fats, oils, and grease (sometimes identified by the acronym FOG) pose a particular problem in the waste treatment industry. These materials are not soluble in water, and as a result, they tend to gather into large masses. Most fats, oils, and grease float, but masses containing these components may also include other, heavier materials. As a result, a holding tank or wet well with waste water may contain numerous masses that may be located almost anywhere in the container.

It has long been known that mixing of the materials in such a setting can be beneficial. The fats, oils, and grease will not dissolve as a result of mixing, but a sufficiently aggressive mixing action can break up large masses or deposits of these materials. In fact, with adequate and continuous mixing, these insoluble materials can be broken up into very small particles that will remain suspended in the solution for relatively long periods, or at least until they are pumped downstream.

By mixing the contents of a waste holding tank or wet well, the large masses containing fats, oils, grease and other materials can be broken up and distributed throughout the liquid solution. The liquid may then be pumped to another container or to another stage of the treatment process. Once these contaminants have been adequately suspended in the solution (i.e., through vigorous mixing), normal pumps and other equipment may be used to move the liquid. The key, therefore, is to provide sufficient mixing prior to attempting to move the material from the holding tank or wet well.

A variety of devices have been used to mix a solution of waste water that contains fats, oils, grease and other contaminants. One approach with promise is the injection of air into the container. Air will rise to the surface. The rising air bubbles will entrain some of the liquid and cause it to also rise. This action can create substantial movement within the liquid. In addition, as the air bubbles reach the surface of the liquid, the air tends to break up masses that have accumulated on or near the surface of the liquid. Fats, oils, and grease often collect at the surface, so this action of the rising air bubbles helps to break up masses of these materials.

Though various air injection devices have been used, there remains a need for a simple, reliable and portable device. Such a device should be positioned near the bottom of a container when in use. The device should be as simple as possible in design to reduce costs of manufacture and maintenance. The device should be small enough for a small crew to handle, and perhaps even small enough for a single operator to use. The device also should use common industrial equipment for providing air flow (e.g., typical blowers). Finally, the device should include some structure to break up the size of the rising air bubbles and to disrupt their flow path. These actions would create a more turbulent flow and thus may enhance the mixing of the materials.

The present invention provides such a device. It is a simple, low-cost solution to the problems identified above. The device is made of rugged, but readily available materials. It can be handled by a small crew, and possibly by a single operator in some circumstances. The present invention allows for free, unrestricted flow of air into the device, but then provides baffles that serve to break up the rising air bubbles (and other materials) and create a more turbulent air flow.

In addition, the present invention does not include any narrow flow paths or constrictions that could allow for the accumulation of contaminants, which could then block the flow through the device. Instead, the present invention uses spaced-apart baffles and an open upper end to create vigorous mixing with minimal clogging of the device. The invention is also relatively easy to clean and to disassemble, if necessary during or after a use. For these reasons, the present invention provides a simple, cost-effective device for mixing of waste water containing contaminants like fats, oils, and grease. This invention is an important departure from the air-flow devices of the past.

SUMMARY OF THE INVENTION

In a preferred embodiment, the invention has a cylindrical outer housing; an air supply hose; at least two baffle plates positioned within the cylindrical outer housing such that a primary surface of each baffle plate is perpendicular to a longitudinal axis of the cylindrical outer housing and each baffle plate is spaced at least two inches from all other baffle plates, and wherein, each baffle plate has a semi-circular outer surface that is configured for connection to the cylindrical outer housing and a straight-cut outer surface is not in contact with the outer surface, with the result being an open flow path between the straight-cut outer surface of each baffle plate and the cylindrical outer housing; each baffle plate has a central opening through which the air supply hose extends, and the straight-cut outer surface of each baffle plate is configured for connection to the air supply hose, so that the air supply hose is held securely in a position near the central longitudinal axis of the cylindrical outer housing; a weighted base; and, a bracket connected to the cylindrical outer housing and the weighted base.

In another preferred embodiment, the invention includes the following steps connecting an air supply hose of the submersible aerator to a blower; turning on the blower, so that air flows through the air supply hose and into a cylindrical outer housing of the submersible aerator; lowering the submersible aerator into a container with a liquid solution by holding the air supply hose and allowing a weighted base of the submersible aerator to sink into the liquid solution until the weighted base is at or near the bottom of the container; positioning the air supply hose so that the cylindrical outer housing is as close to vertical as the conditions allow; operating the submersible aerator until the liquid solution has been adequately mixed; removing the submersible aerator from the liquid solution by pulling the air supply hose in an upward direction; and, turning off the blower when the submersible aerator is clear of the liquid solution.

DETAILED DESCRIPTION OF PREFERRED EMBODIMENTS OF THE INVENTION

Figure 1:
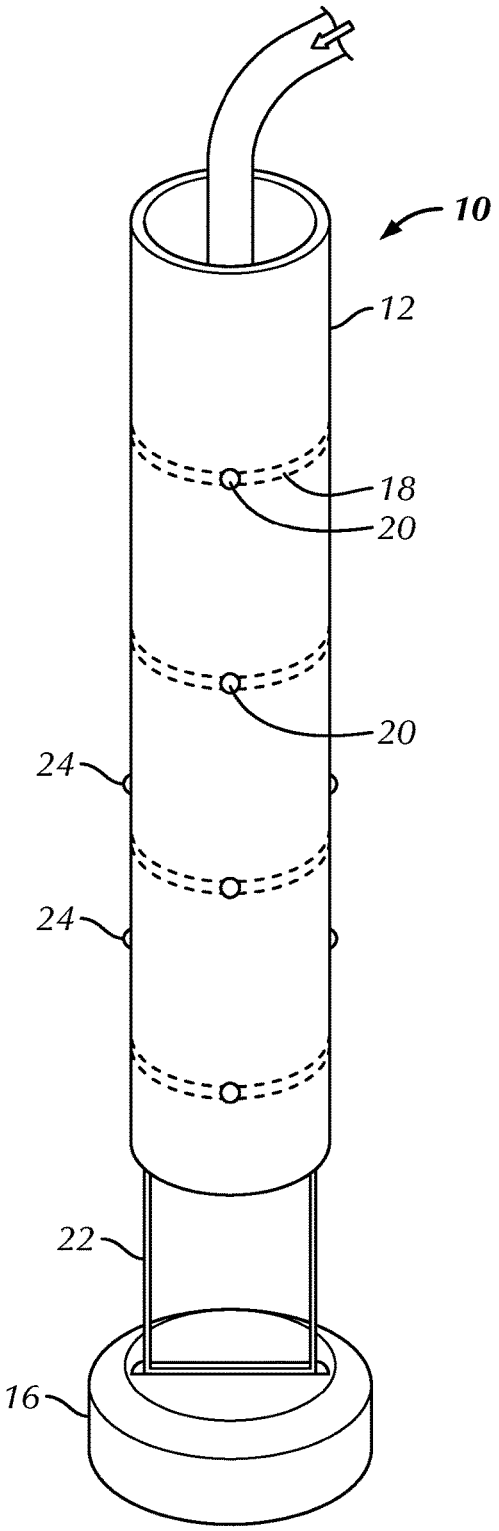
FIG. 1 is a perspective view of a preferred embodiment of the present invention.

A perspective view of a submersible aerator 10 is shown in FIG. 1. The aerator 10 has a cylindrical outer housing 12, an air supply hose 14, and a weighted base 16. There are baffle plates 18 located within the housing 12, but these cannot be directly seen in FIG. 1. The baffles 18 are secured to the housing 12 using baffle plate bolts 20, which are visible in FIG. 1.

The aerator 10 is used by lowering the unit into a holding tank, wet well, or other container with liquid that needs vigorous mixing. The air supply hose 14 is of rugged design, with a relatively thick side wall. This type of hose is used to provide sufficient strength and rigidity to the supply hose 14. The hose 14 supplies air to the aerator 10 during use, but the same hose 14 is also used by operators to raise, lower, or reposition the aerator 10. By using a sufficiently strong and rigid air supply hose 14, the present invention provides a simple, but highly effective, aerator that is easily handled for a small crew or even a single operator.

In a preferred embodiment, the air supply hose is a one inch outside diameter hose with a side wall thickness of at least ⅛ inch. This configuration provides an inner diameter of ¾ inch, which is sufficient for most applications. If more air flow is needed, a larger air supply hose can be used, but this may require use of different baffle plates 18, because these plates have a central opening sized to matched the outer diameter of the supply hose 14. This point is explained more below.

In use, the aerator 10 should be generally vertical. That is, the outer housing 12 should be nearly vertical so that the air bubbles rise in a path parallel to the axis of the housing 12. Given the nature of the containers in which this invention is used, it may not always be possible to position the device in a perfectly vertical alignment, but it is important that the device be at least generally vertical when in use. For example, some containers have awkward access points and others may be so clogged with masses of solids that it is impossible to achieve a truly vertical alignment of the outer housing 12. Even in these situations, it remains important to get the housing 12 into at least a somewhat vertical arrangement.

This result is achieved through use of the weighted base 16. The base may be made of any suitably heavy material, such a lead, stainless steel, or even concrete. The device, however, may be used in environments containing highly corrosive materials, and some concrete may not be suitable for such environments. In one preferred embodiment, a stainless steel base weighing approximately 10 pounds is used. This provides sufficient weight to keep the outer housing 12 in a generally vertical alignment in most situations. At 10 pounds, the base 16 is light enough for one or two persons to easy handle (i.e., together with the weight of the rest of the device).

The base 16 is attached to the housing 12 by a bracket 22. This allows for a space between the base and the open, lower end of the housing 12. This arrangement keeps the lower end of the housing 12 raised from the bottom of the container. This can be important because some containers have a large amount of solid or semi-solid material near the bottom. The bracket 22 effectively raises the lower end of the housing 12 enough to ensure it is above the level of such materials in most situations. The bracket 22, however, is compact enough to ensure the lower end of the housing 12 is close enough to the bottom of the container to ensure there is vigorous and complete mixing of all materials, including those that may be lodged near the bottom of the container. The bracket 22 is secured to the housing 12 using bracket bolts 24. Rivets, machine screws, commercial adhesive, or other means also may be used to secure the bracket 22 to the housing 12.

Figure 2:
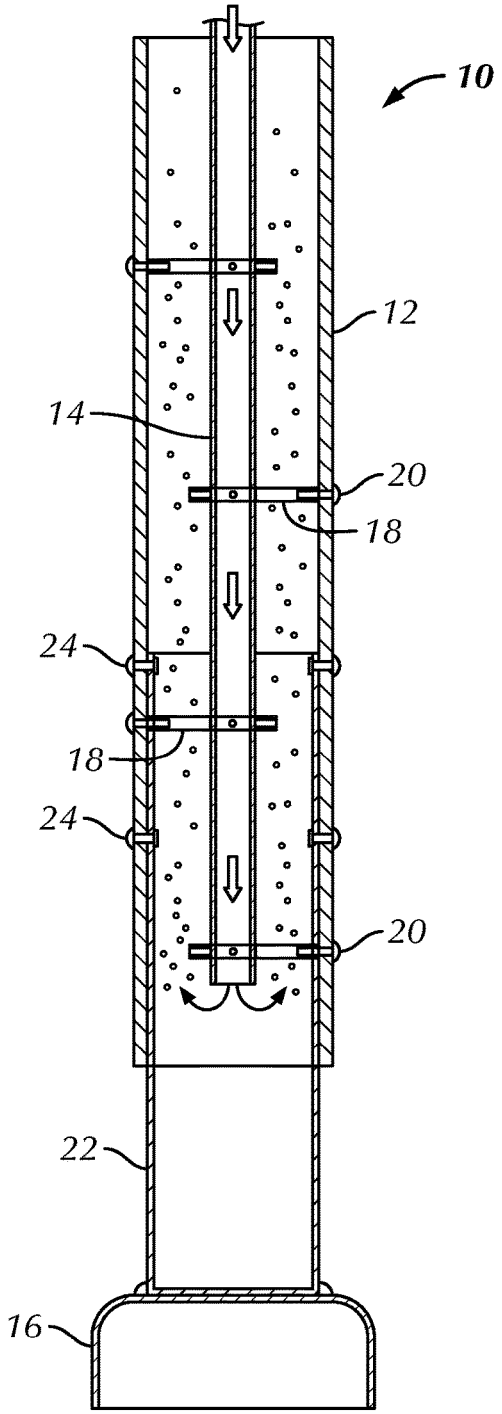
FIG. 2 is a side cross-sectional view of the key components of a preferred embodiment of the present invention.

The key operational parts of the aerator 10 are shown in FIG. 2. The air supply hose 14 is shown entering the upper end of the housing 12. The baffle plates 18 are shown in a side cross-sectional manner. Though it cannot be directly seen in FIG. 2, the baffle plates 18 have a central opening sized to match the outer diameter of the air hose 14. In addition, as will be explained more below, the air hose 14 is secured to each baffle plate 18 using a bolt, screw, or other means. This configuration secures the air hose 14 to the baffle plates 18. The baffle plates 18 are secured to the outer housing 12 using baffle plate bolts 20, or other equivalent securing means (e.g., rivets, screws, or adhesive).

This configuration is simple, but effective. The air hose 14 is rigid enough to support the weight of all other components. The hose 14 is secured to the baffle plates 18, which are secured to the housing 12. The entire assembly is secure, strong, and relatively simple to assemble or disassemble. In the embodiment shown in FIG. 2, the base bracket 22 is secured using rivets 24. The bracket may be secured to the weighted base 16 by welding, screws, or a suitable adhesive. In a preferred embodiment, the base 16 is welded to the bracket 22.

The operation of the invention can be explained using FIG. 2. Air is supplied (e.g., by any suitable commercial blower) through the air hose 14. There are no restriction on the hose 14. Instead, the end of the hose 14 is open at a point below the lowest of the baffle plates 18. This allows for a full and free flow of air into the aerator 10. It also means that as air leaves the open end of the supply hose 14, the bubbles first created will be rather large. This is preferred to prevent clogging of the air supply hose 14 during use. In fact, in a preferred method of operation, the air supply is on (i.e., the surface blower is providing air through the hose 14) when the aerator 10 is first placed into the solution. This ensures there is a positive flow of air at all times, which greatly reduces the risk of clogging.

As the large air bubbles leave the open end of the hose 14, they begin to rise. These rising, large air bubbles quickly come into contact with the lowest baffle plate 18. The baffle plate covers move than half the horizontal cross section of the housing 12, which ensure that most of the rising bubbles will hit the plate. This action will break up or cleave the bubbles, resulting in smaller bubbles and more turbulence. The same action occurs as the bubbles rise and strike the other baffle plates 18. The bubbles continue to become smaller as they rise.

This aspect of the invention is important, because it is believed that smaller aggressive bubbles help to break up smaller masses of contaminants. During the early stages of operation of the aerator in a heavily contaminated liquid, there may be nothing but large masses in the solution. But as the aerator 10 operates, the masses will break up into smaller and smaller particles. By ensuring that the rising bubbles become smaller as they rise, the aerator 10 is able to continue breaking up even small masses of contaminants. The end result is a liquid solution in which most fats, oils, and grease are distributed evenly throughout the liquid. When this result is achieved, these insoluble contaminants will remain in suspension for a relatively long period of time, a period that should be long enough to allow for pumping or other transfer of the solution from the container.

To better facilitate this action—that is, breaking up the rising air bubbles and inducing more turbulence into the flow—the baffle plates are positioned so that their open sections are not aligned. To explain this aspect, it is helpful to view FIG. 3, which shows a top (or bottom) view of a baffle plate 18. Note that the left side of the baffle plate 18 is cut off. That is, the plate 18 is semi-circular with one straight side cut along a chord across the circular arc. When this baffle plate 18 is positioned within the housing 12, the semi-circular sides of the baffle 18 fit against the inner surface of the housing 12. The straight-cut side (on the left in FIG. 3) of the baffle 18 produces an open region in the housing, and this is the path the air bubbles (and entrained liquid and contaminants) take as they rise through the housing 12. The baffle plates 18 are aligned to that their straight-cut sides are out of line.

Figure 3:
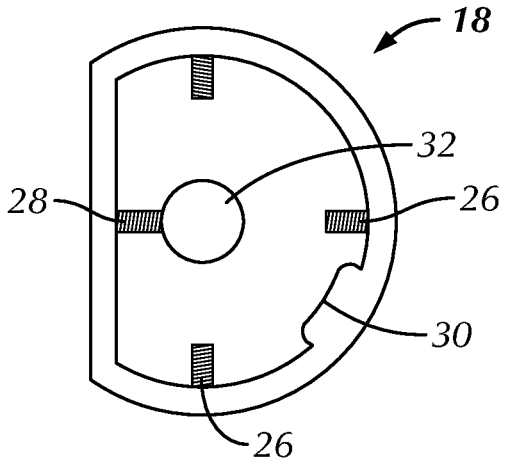
FIG. 3 is a top view of a baffle plate used in a preferred embodiment of the present invention.

Imagine, for example, that the baffle plate 18 shown in FIG. 3 is the lowest baffle plate shown in FIG. 2. In this configuration, the open lower end of the air supply hose 14 would be just below this baffle plate 18. The large air bubbles leaving the hose 14 would rise. Any air bubbles that rise along the right side of the housing will hit the solid part of the baffle plate 18. These bubbles will be broken up or cleaved into smaller bubbles, and will eventually (this takes very little time in actual operation) will migrate to the left, where there is an open area between the straight-cut side of the baffle plate 18 and the inner surface of the housing 12. This open area is relatively large to reduce the risk of clogging.

We can follow the path of the rising air bubbles, some of which is now smaller due to their impact with the lowest baffle plate. Because the opening associated with the lowest baffle plate shown in FIG. 2 is on the left side, there may be a larger concentration of rising bubble on the left side in this embodiment. The next highest baffle plate 18 is positioned in an opposite manner to that seen in FIG. 3. That is, the next baffle plate 18 is positioned so that its straight-cut side is on the right. This means the open path for the flow of air bubbles and entrained matter will now be on the right side of the housing. This arrangement causes more disruption, thus breaking up the air bubbles into even smaller bubbles and created more turbulent flow. This process continues up the vertical length of the housing 12. This structural configuration produces vigorous mixing, while keeping the device simple.

Figure 4:
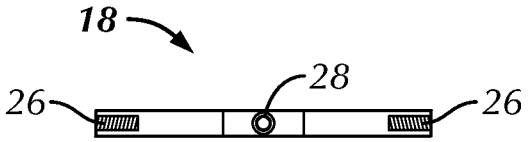
FIG. 4 is a side view of a baffle plate used in a preferred embodiment of the present invention.

The baffle plate 18 shown in FIG. 3 could be rotated either 180°, which is what was described above. Alternatively, the baffle plate 18 could be rotated by 90° from one level in the housing to the next. There is no clear preference between these options, but it is preferred to use either one-quarter or one-half rotations. This preference is driven by the desire to keep the baffle plate 18 simple and consistent. All baffle plates 18 may be made exactly as the one shown in FIGS. 3 and 4, if this type of rotation is used. Note that the baffle plate 18 has three threaded holes 26 along the semi-circular circumference, and one threaded hole 28 at the center of the straight-cut side of the baffle plate 18. These holes are positioned 90° apart. This allows for either 90° or 180° rotation of the baffle plates 18 within the housing 12.

The three threaded holes 26 are used to secure the baffle plates 18 to the housing 12. The baffle bolts 20 (as seen in FIGS. 1 and 2) are used for this purpose. The threaded hole 28 along the straight-cut side of a baffle plate 18 is used to secure the air supply hose 14 to the baffle plate 18. In a preferred embodiment, a set screw or bolt is used for this purpose and is tightened until it creates a secure connection to the air hose 14. The screw used for this purpose can pierce the hose 14 without causing concern, however, because there will be only clean air flowing down the hose 14 during normal operations. In addition, in the even the hose 14 does become clogged (perhaps due to the aerator 10 being used incorrectly), the hose may be easily removed and replaced. The air hose 14 is positioned in the central opening 32 of each baffle plate.

The baffle plate 18 shown in FIG. 3 has a notch 30 in the semicircular part of its circumference. This notch allows for a small amount of flow, and serves to create additional turbulence. In a preferred embodiment, a notch 30 may be included in the lower two baffle plates 18 to allow space for the bracket 22 that connects the weighted base 16 to the housing 12. If this design is used, the upper baffle plates 18 could be made without the notch 30, though retaining it may provide even greater mixing. Alternatively, a bracket 22 could be used that is positioned on the outside surface of the housing, so that the notch 30 would not be required. These design variations are not critical to the operation of the invention.

It also should be noted that it is not necessary to the operation of the invention that the baffle plates 18 be rotated as explained above. Such a configuration is preferred for two reasons. First, as explained above, it is believed that this arrangement will produce better results during use of the invention. Second, this arrangement may produce a more solid and rigid device, because the connections between the housing 12 and the baffle plates 18 will be spaced apart rather than all aligned. But the invention can be made and used with all the straight-cut sides of the baffle plates 18 aligned. This is not preferred, but it is within the scope of the invention, and may be easier to assemble.

Finally, it also should be noted that the present invention does not include any barriers or obstacles to flow other than the baffle plates 18. The plates are spaced well apart and all include a relatively large open area between their straight-cut side and the housing 12. The purpose of this design is to provide turbulence and break up the air bubbles without unduly restricting the flow. This invention is designed for use in environments that may contain large masses of insoluble fats, oils, and grease. It is important, therefore, to ensure that the flow path is clear enough to prevent these types of materials from clogging within the device. The present invention achieves this result using a novel, but simple, design.

While the preceding description is intended to provide an understanding of the present invention, it is to be understood that the present invention is not limited to the disclosed embodiments. To the contrary, the present invention is intended to cover modifications and variations on the structure and methods described above and all other equivalent arrangements that are within the scope and spirit of the following claims.

I claim:

1. A submersible aerator apparatus, comprising:

a. an elongated cylindrical outer housing having an open upper end and an open lower end;

b. an air supply hose that enters the apparatus through the open upper end of the cylindrical outer housing and that terminates at a point near the open lower end of the cylindrical outer housing, but within the cylindrical outer housing;

c. at least two baffle plates positioned within the cylindrical outer housing such that a primary surface of each baffle plate is perpendicular to a longitudinal axis of the cylindrical outer housing and each baffle plate is spaced at least two inches from all other baffle plates, and wherein, i. each baffle plate has a semi-circular outer surface that is configured for connection to the cylindrical outer housing and a straight-cut outer surface that is not in contact with the cylindrical outer housing, with the result being an open flow path between the straight-cut outer surface of each baffle plate and the cylindrical outer housing;

ii. each baffle plate has a central opening through which the air supply hose extends;

d. a unitary weighted base that is physically separate from the cylindrical outer housing; and, e. a bracket connected to the cylindrical outer housing and the weighted base.

2. The apparatus of claim 1, wherein the weighted base is positioned at least two inches below the cylindrical outer housing.

3. The apparatus of claim 1, wherein the outer diameter of the air supply hose is at least one inch.

4. The apparatus of claim 1, wherein the at least two baffle plates are aligned in the cylindrical outer housing in such a manner that the open flow path created by a first of the at least two baffle plates does not align with the open flow path created by another of the at least two baffle plates positioned immediately above or below the first baffle plate.

5. The apparatus of claim 1, wherein there are four baffle plates.

6. The apparatus of claim 5, wherein the four baffle plates are vertically aligned in the cylindrical outer housing so that the open flow path created by each baffle plate is not aligned with the open flow path created by the other baffle plate or plates immediately above or below the baffle plate.

7. The apparatus of claim 5, wherein each baffle plate is secured to the cylindrical outer housing by at least three bolts.

8. The apparatus of claim 5, wherein the weighted base weighs at least 15 pounds.

9. The apparatus of claim 8, wherein the weighted base is made of stainless steel.

10. The apparatus of claim 5, wherein the air supply hose has an open end positioned just below a lowest of the four baffle plates, but wherein the open end of the air supply hose is positioned at least one inch above a lower end of the cylindrical outer housing.

11. An apparatus for mixing a liquid in a container, the apparatus comprising:

a. an elongated cylindrical outer housing having an open upper end and an open lower end;

b. four baffle plates connected to the cylindrical outer housing so that a primary surface area of each baffle plate is perpendicular to a longitudinal axis of the cylindrical outer housing, wherein, i. each baffle plate has a semi-circular outer surface that is configured for connection to the cylindrical outer housing; and, ii. a straight-cut outer surface that is not in contact with the cylindrical outer housing, with the result being an open flow path between the straight-cut outer surface of each baffle plate and the cylindrical outer housing;

c. an air supply hose positioned within a central opening in each baffle plate and secured to each baffle plate, wherein the air supply hose enters the apparatus through the open upper end of the cylindrical outer housing and terminates at a point near the open lower end of the cylindrical outer housing, but within the cylindrical outer housing;

d. a unitary weighted base that is physically separate from the cylindrical outer housing; and, e. a bracket connected to the cylindrical outer housing and to the weighted base.

12. The apparatus of claim 11 wherein each baffle plate is spaced at least three inches from every other baffle plate.

13. The apparatus of claim 12, wherein the air supply hose terminates at least one inch above the open lower end of the cylindrical outer housing.

* * * * *